US010786825B2

(12) United States Patent
Camilleri et al.

(10) Patent No.: US 10,786,825 B2
(45) Date of Patent: Sep. 29, 2020

(54) PAINT CONTAINER COMPRISING AN OPTIMISED AIR INLET VALVE

(71) Applicants: Michel Camilleri, Souffelweyersheim (FR); Joseph Guarino, Mazan (FR)

(72) Inventors: Michel Camilleri, Souffelweyersheim (FR); Joseph Guarino, Mazan (FR)

( * ) Notice: Subject to any disclaimer, the term of this patent is extended or adjusted under 35 U.S.C. 154(b) by 0 days.

(21) Appl. No.: 16/477,868

(22) PCT Filed: Dec. 27, 2017

(86) PCT No.: PCT/EP2017/084652

§ 371 (c)(1),
(2) Date: Jul. 12, 2019

(87) PCT Pub. No.: WO2018/137879

PCT Pub. Date: Aug. 2, 2018

(65) Prior Publication Data

US 2019/0366364 A1 Dec. 5, 2019

(30) Foreign Application Priority Data

Jan. 27, 2017 (FR) ..... 17 50703

(51) Int. Cl.
*B05B 7/24* (2006.01)
*B01F 15/02* (2006.01)
(Continued)

(52) U.S. Cl.
CPC ..... *B05B 7/2483* (2013.01); *B01F 15/02* (2013.01); *B05B 7/2472* (2013.01); *B44D 3/12* (2013.01); *B05B 7/2408* (2013.01); *B05B 15/40* (2018.02)

(58) Field of Classification Search
CPC ..... F16K 13/02; B05B 7/2483
(Continued)

(56) References Cited

U.S. PATENT DOCUMENTS 1,290 A * 8/1839 Kellogg et al. ..... F16K 27/067 251/309
2,805,801 A * 9/1957 Jacobs ..... B65D 47/30 222/545
(Continued)

FOREIGN PATENT DOCUMENTS

EP 1930084 A1 6/2008
WO 2005115631 A1 12/2005
(Continued)

OTHER PUBLICATIONS

International Search Report and Written Opinion for International Application No. PCT/EP2017/084652 dated Apr. 13, 2018, 9 pages.

*Primary Examiner* — Kenneth Rinehart
*Assistant Examiner* — Nicole Gardner
(74) *Attorney, Agent, or Firm* — Suiter Swantz pc llo

(57) ABSTRACT

The invention concerns a disposable container (1), intended to contain at least one liquid component to be sprayed and having a bottom (3), at least one peripheral side wall (2) extending from the bottom (3) to an open end spaced apart from and facing said bottom (3), which is provided with a closable vent device (6), characterised in that the closable vent device (6) comprises an aperture (7) forming an air passage, provided in the bottom, and a rotary valve (8) mounted on an outer surface (3*a*) of said bottom (3) in the extension of the aperture (7), in order to close and open the air passage.

10 Claims, 8 Drawing Sheets

(51) Int. Cl.
*B44D 3/12* (2006.01)
*B05B 15/40* (2018.01)

(58) Field of Classification Search
USPC ..... 239/347; 251/147, 149.2, 235, 309, 352, 251/353
See application file for complete search history.

(56) References Cited

U.S. PATENT DOCUMENTS

| | | | | | |
|---|---|---|---|---|---|
| 3,023,939 | A * | 3/1962 | Gustafson | B65D 47/305 | 222/536 |
| 3,251,516 | A * | 5/1966 | Thomas | B65D 47/305 | 222/536 |
| 3,502,248 | A * | 3/1970 | Newby | B65D 47/305 | 222/534 |
| 3,906,999 | A * | 9/1975 | Manoogian | F16K 5/0605 | 137/625.32 |
| 4,428,507 | A * | 1/1984 | Sneider | A61J 1/05 | 222/105 |
| 2006/0113409 | A1* | 6/2006 | Camilleri | B05B 7/2408 | 239/600 |
| 2014/0332532 | A1 | 11/2014 | Wang | | |
| 2015/0360248 | A1* | 12/2015 | Camilleri | B01F 15/00512 | 206/221 |

FOREIGN PATENT DOCUMENTS

| | | | |
|---|---|---|---|
| WO | 2014108606 | A1 | 7/2014 |
| WO | 2016180863 | A1 | 11/2016 |

* cited by examiner

PAINT CONTAINER COMPRISING AN OPTIMISED AIR INLET VALVE

CROSS-REFERENCE TO RELATED APPLICATIONS

The present application is a national stage filing under 35 U.S.C. 371 of International Application No. PCT/EP2017/084652, filed on Dec. 27, 2017 and entitled "Paint Container Comprising an Optimised Air Inlet Value," which claims priority to the French patent application No. 1750703, filed with the National Industrial Property institute on Jan. 27, 2017 and entitled "Paint Container Having an Air Inlet Valve Optimized," whereby each of the above-listed patent applications are incorporated herein by reference in their entirety.

TECHNICAL FIELD

The present invention relates to the general technical field of containers containing sprayable liquids and spraying systems, apparatus or devices. These containers are generally used for packaging, preparation and working with a paint or spray gun or for the storage, application and eventual conservation of a product originating from a mixture of at least two components.

SUMMARY

More particularly, the invention relates to a disposable set or kit, separately containing the two or more components to be mixed prior to the use thereof, after the mounting thereof by means of an adapter part onto a paint gun.

In the domain of bi-component and more generally multi-component paint products, to paint or to be propelled or sprayed, for example paints, primers, varnishes and other products, each of the two or more components of the final product must be packaged separately. These components are mixed at the last moment, just before being used, because after a certain amount of time it is no longer possible to propel or spray them, for example because they clump, harden or become pasty. Furthermore, these components are generally sensitive to air and/or to light and must be separately packaged within sealed and/or opaque containers.

When a bi-component or multi-component product has to be sprayed, the operator must generally perform the pre-mixing of the components of the product himself, before then transferring the mixture to a container that is suitable for the spraying tool thereof, each of the components of the product is then initially individually packaged within a separate container.

This preparation of sprayable bi-component or multi-component products presents numerous disadvantages, amongst which the following can be particularly cited:

- bulky and costly commercial packaging for bi-component products insofar as each of the components must be individually packaged within a separate container;
- risks of component or product spillage and loss during the preparation of the product to be sprayed due to multiple transfer operations from one container to another;
- risks of wrong dosage by the operator during the preparation of the product to be sprayed, which can negatively impact the effectiveness of the bi-component product obtained;
- cumbersome storage of partially emptied containers for each of the components after mixing,
- deterioration in air of those remaining components stored within partially emptied containers;

- the preparation time necessary when mixing the components, while the increasing cost of labor leads employers to find solutions for increasing the work rate.

In the domain of painting or of spraying by means of a gravity fed, suction fed or similar paint spray gun, there are very few single use bi-component packagings.

In order to make the painting or spraying work easier and faster but also more economical in terms of products and materials, the present invention aims to provide a new packaging and working container serving as disposable cup for mounting onto a spraying tool.

Another object of the invention is to improve the extraction, for example by means of gravity, of the liquid component contained within a container serving as a cup or tank for spraying.

The objects of the invention are achieved with a disposable container, intended to contain at least one liquid component to be sprayed and having a bottom, at least one peripheral side wall extending from the bottom to an open end spaced apart from and facing said bottom, which is provided with a closable vent device, characterised in that the closable vent device comprises an aperture forming an air passage, provided in the bottom, and a rotary valve mounted on an outer surface of said bottom in the extension of the aperture, in order to close and open the air passage.

According to an exemplary embodiment of the container according to the invention, the rotary valve has a rotation axle extending in a plane parallel to the outer surface, tightly fitted into a jaws that are connected to, and projecting from, said outer surface of the bottom.

According to an exemplary embodiment of the container according to the invention, the rotary valve comprises a movable actuating lever rotatable between two positions in abutment constituting end positions, and corresponding respectively to the opening and the closing of the aperture.

According to an exemplary embodiment of the container according to the invention, the actuating lever, when the rotary valve is in the open position, protrudes on the outer surface of the bottom and extends beyond the other parts of the bottom also projecting on said outer surface.

According to an exemplary embodiment of the container according to the invention, the rotary valve comprises a central cylindrical portion in contact with the outer surface of the bottom and terminating longitudinally at each side by a coaxial end of a smaller diameter in order to constitute the rotation axle engaged within a jaw.

According to an exemplary embodiment of the container according to the invention, the cylindrical portion has a radial through duct in order to make it possible, depending upon the rotational position of the valve, to open the air passage by placing the aperture of the bottom in communication with open air or to close said aperture.

According to a further exemplary embodiment of the container according to the invention, the cylindrical portion has a groove open towards the exterior and located on at least a quarter turn of the cylindrical portion, in order to make it possible, depending upon the rotational position of the valve, to open the air passage by placing the aperture of the bottom in communication with open air or to close said aperture.

According to an exemplary embodiment according to the invention, the container and the jaws are manufactured as one piece.

According to an exemplary embodiment of the container according to the invention, the rotation axle and the cylindrical portion are manufactured as one piece.

According to an exemplary embodiment according to the invention, the container is pre-filled with at least one product such as paint, varnish or a cleaning product, and comprises a closing element such as a cover or sealing film.

According to an exemplary embodiment according to the invention, the container comprises internally at least one removable wall allowing for the realization of at least one sealed compartment for storing and isolating at least one additional component.

The objects of the invention are also achieved by means of a cup or tank for spraying apparatus comprising a container such as that discussed above, a removable lid for closing the disposable container, said lid being provided with an opening for supplying the spraying apparatus and a filter for filtering the liquid exiting the container through said opening, and an adapter mounted onto the opening in order to realize a detachable connection with said spraying apparatus.

The container according to the invention has the advantage of having within the bottom thereof a groove for engagement with an inner tube, the design of which improves the seal between said bottom and said inner tube. Furthermore, the container can be used without the inner tube and this without any structural modification.

The groove of the container according to the invention also provides better retention of the inner tube and increases the stability of the bottom. Indeed, the structure projecting from an outer face reduces the risk of deformation of the bottom and of the container, which is very advantageous when said container is closed by means of a sealing film. The shape of the groove also improves the supporting of the container upon a plane.

Furthermore, the bottom is flat and devoid of raised elements that are likely to interfere with a mixing operation when using a stirring rod.

The container according to the invention also comprises a closable vent device that is remarkably simple, reliable and economical.

BRIEF DESCRIPTION OF THE DRAWINGS

Other characteristics and advantages of the invention will appear in the following description, given as a non-limiting example and accompanied by drawings wherein.

DETAILED DESCRIPTION

Figure 1:
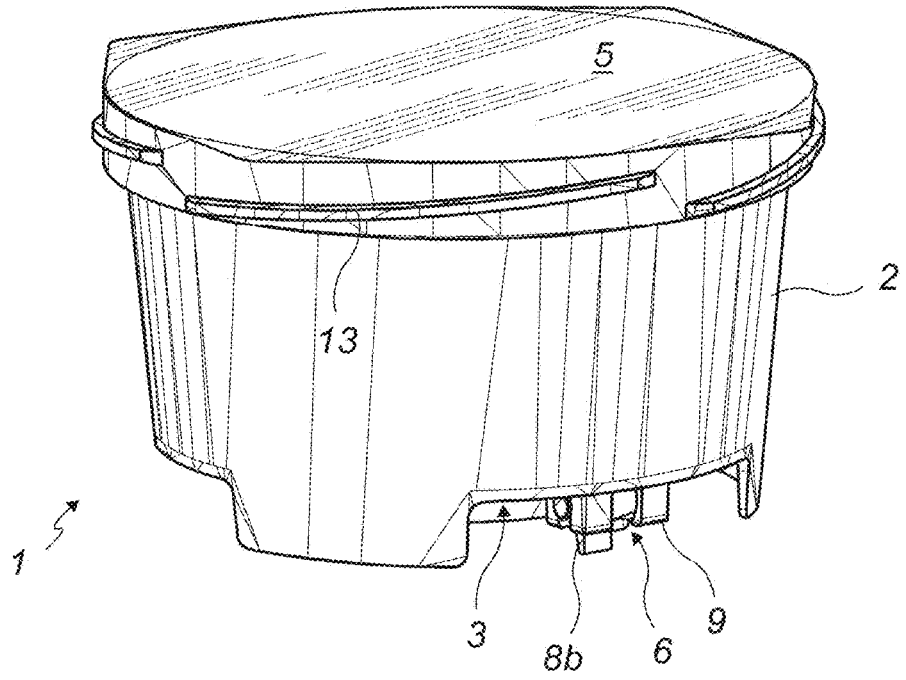
FIG. 1 is a perspective illustration of an exemplary embodiment of a container according to the invention.

FIG. 1 illustrates according to a perspective view an exemplary embodiment of a container 1 according to the invention. Said container, of a generally substantially cylindrical or truncated conical shape, has a peripheral side wall 2 extending from a bottom 3 to an open end 4. The latter is more precisely visible in FIG. 2.

Figure 2:
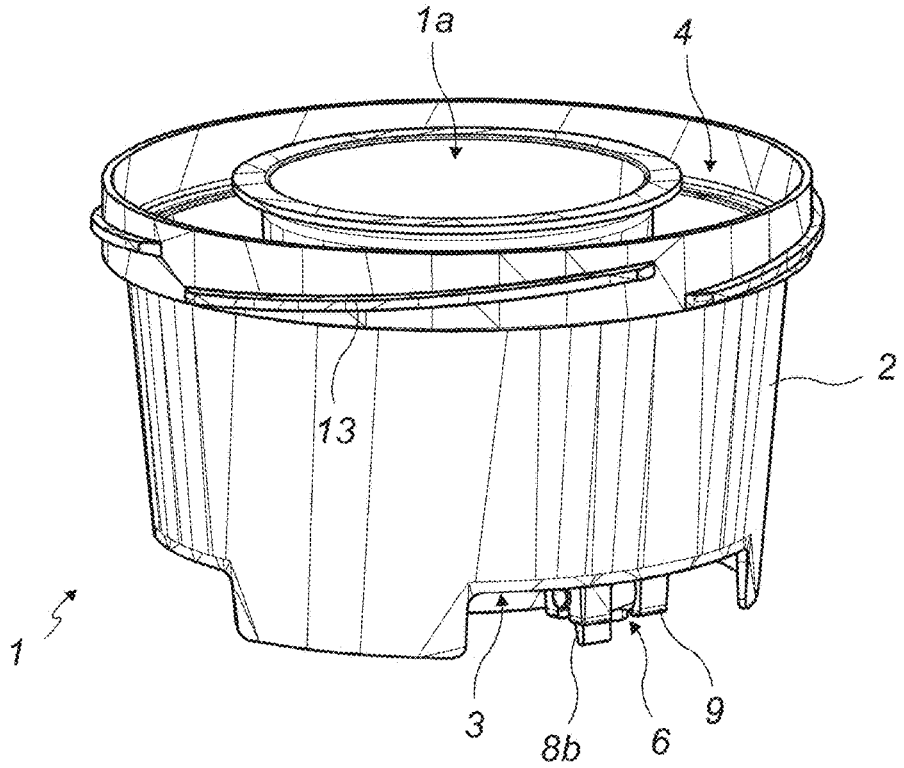
FIG. 2 is an illustration of the container of FIG. 1 wherein the sealing film has been removed.

FIG. 2 shows for example an embodiment of the container 1 provided with an inner compartment delimited by an inner tube 1*a*. The open end 4, also referred to as a connection end, is advantageously closed by means of a sealing film 5 when the container 1 is filled with one or more products.

Figure 3:
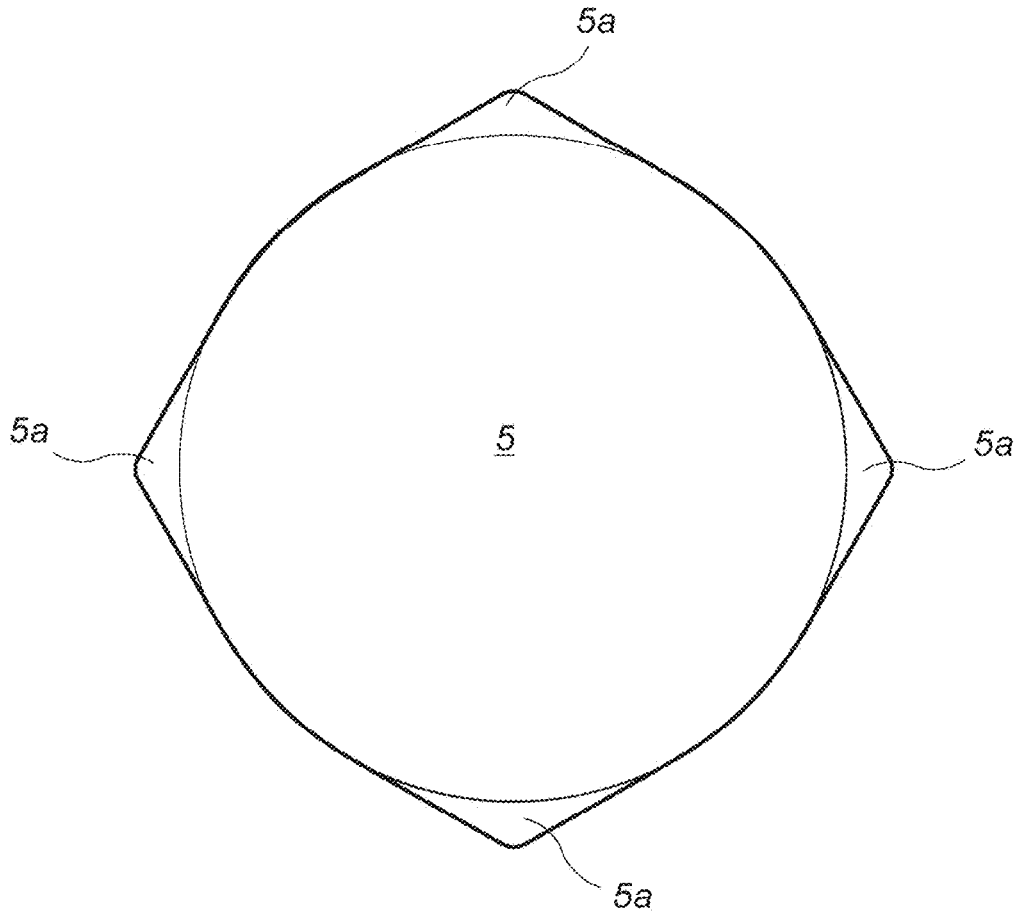
FIG. 3 is an illustration in top plan view of a sealing film closing the opening of the container according to the invention in top plan view.

The sealing film 5 is shown, not attached to the container 1, in FIG. 3 in top plan view. The sealing film 5 has one or more gripping tabs 5*a* accessible at the periphery thereof in order to permit better gripping when uncoupling it from the container 1.

The container 1 is also provided, centrally or off-center, on an outer face 3*a* of the bottom 3 with a closable vent device 6. The latter is shown respectively closed and open, for example in FIGS. 1 and 3.

The closable vent device 6 comprises an aperture 7 formed in the bottom 3 such as to form an air passage. Said aperture 7 is illustrated in particular in FIGS. 9, 11, 12 and 13.

Figure 4:
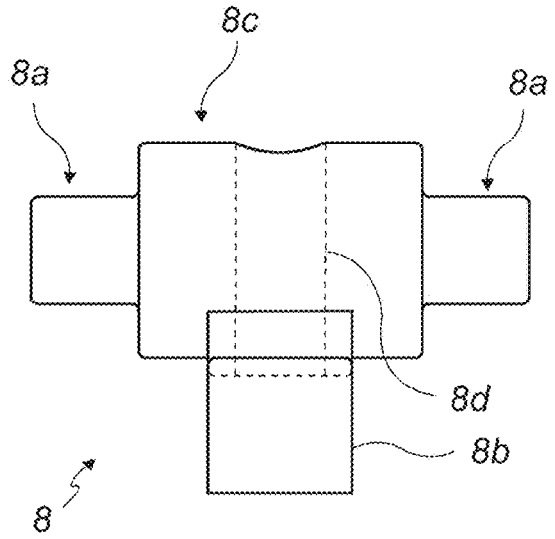
FIG. 4 is an illustration in top plan view of a rotary valve according to a first embodiment mounted on the container according to the invention.
Figure 5:
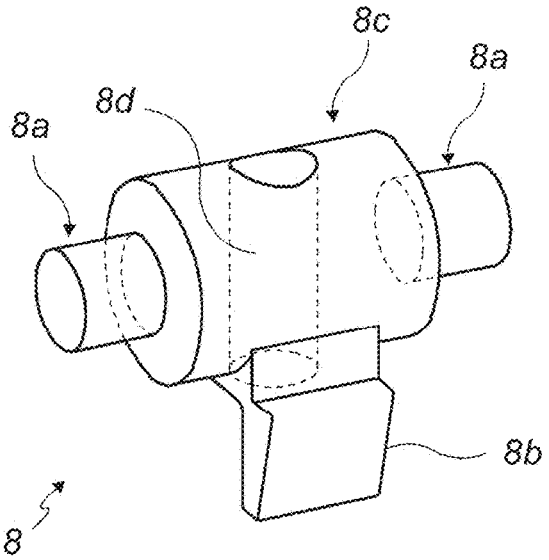
FIG. 5 is a perspective view of the valve illustrated in FIG. 4.
Figure 6:
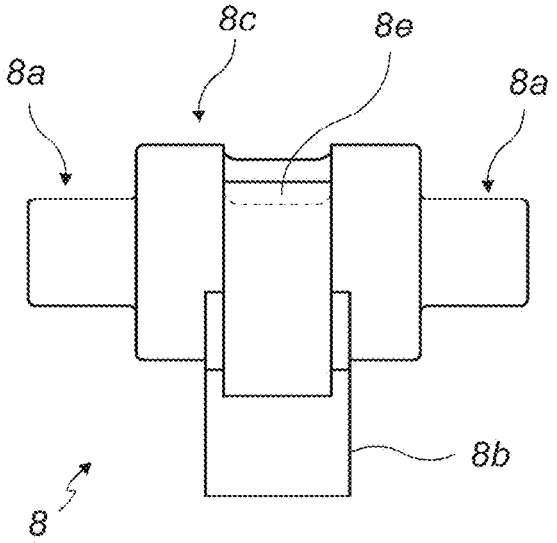
FIG. 6 is an illustration in top plan view of a rotary valve according to a second embodiment mounted on the container according to the invention.
Figure 7:
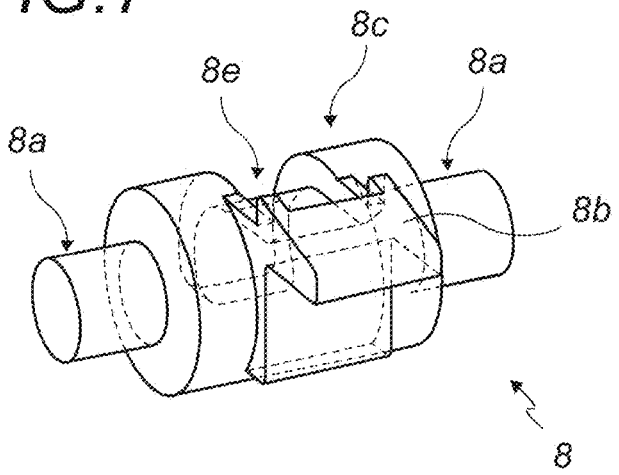
FIG. 7 is a front perspective view of the valve illustrated in FIG. 6.
Figure 8:
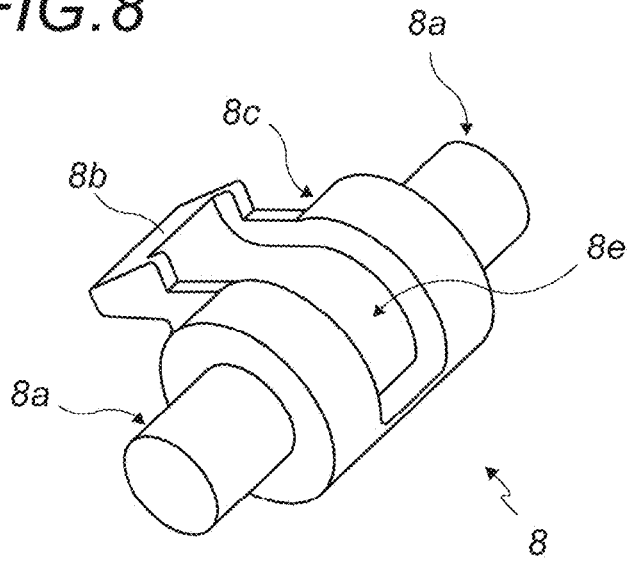
FIG. 8 is a rear perspective view of the valve illustrated in FIG. 6.

The closable vent device 6 also comprises a rotary valve 8, whereof a first embodiment is illustrated in more detail in FIGS. 4 and 5 and whereof a second embodiment is illustrated in more detail in FIGS. 6 to 8. The rotary valve 8 is mounted on an outer surface 3*a* of the bottom 3 and within the extension of the aperture 7. Reference may be made more particularly to FIGS. 9, 11, 12 and 13.

The rotary valve 8 has a rotation axle 8*a* extending in a plane parallel to the external surface 3*a* and press fitted into jaws 9. The jaws 9 are advantageously integral with and projecting from the outer surface 3*a*.

The rotary valve 8 advantageously comprises an actuating lever 8*b* for moving said rotary valve 8 between two positions in abutment constituting end positions. Said two abutment positions respectively correspond to an opening and a closing of the aperture 7.

The rotary valve 8 also comprises a central cylindrical portion 8*c*. The latter is in contact with the outer surface 3*a* of the bottom 3 and terminates longitudinally and axially on each side with a coaxial end of a smaller diameter in order to constitute the rotation axle 8*a* engaged within a corresponding jaw 9.

According to a first embodiment of the rotary valve 8, the cylindrical portion 8*c* has also a radial and traversing duct 8*d*, that makes it possible, depending upon the rotational position of the rotary valve 8, to open the air passage by placing the aperture 7 in communication with open air or to close said aperture 7. Such a rotary valve 8 is shown in FIGS. 4 and 5.

According to a second embodiment of the rotary valve 8, the cylindrical portion 8*c* has a groove 8*e* opened towards the exterior, for example over a quarter turn of the cylindrical portion 8*c*, in order to make it possible, depending upon the rotational position of the valve 8, to open the air passage by placing the aperture 7 in communication with open air or to close said aperture 7. Such a rotary valve 8 is shown in FIGS. 6 to 8.

Figure 9:
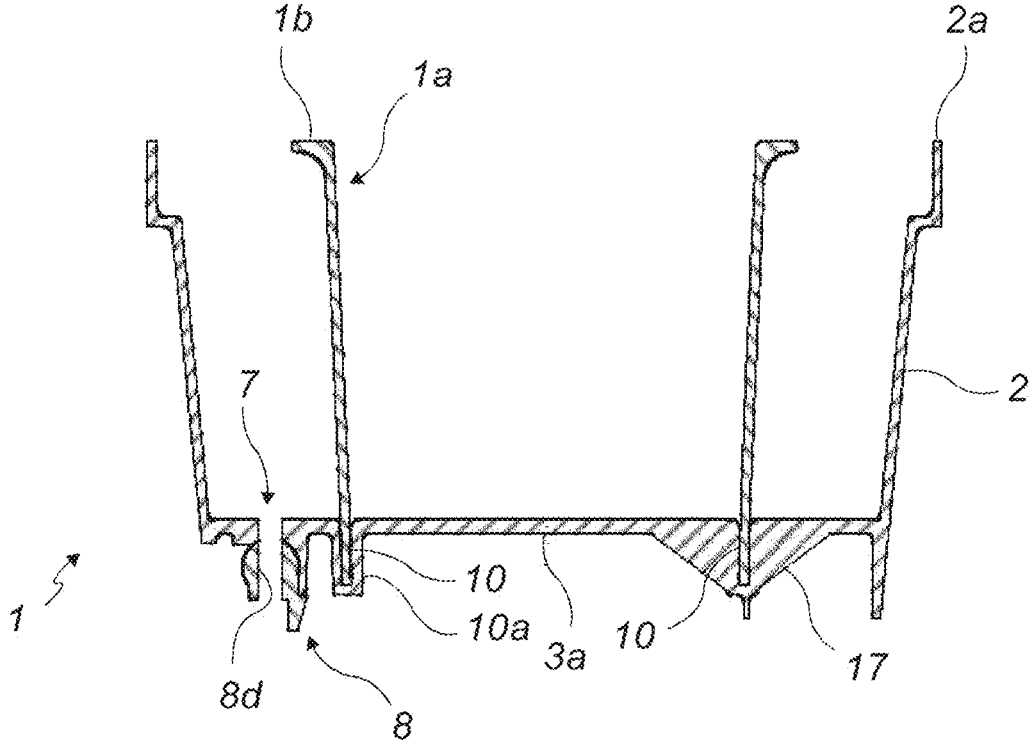
FIG. 9 is a sectional view of an exemplary embodiment of a container according to the invention for a multi-component application with the rotary valve in the open position.
Figure 10:
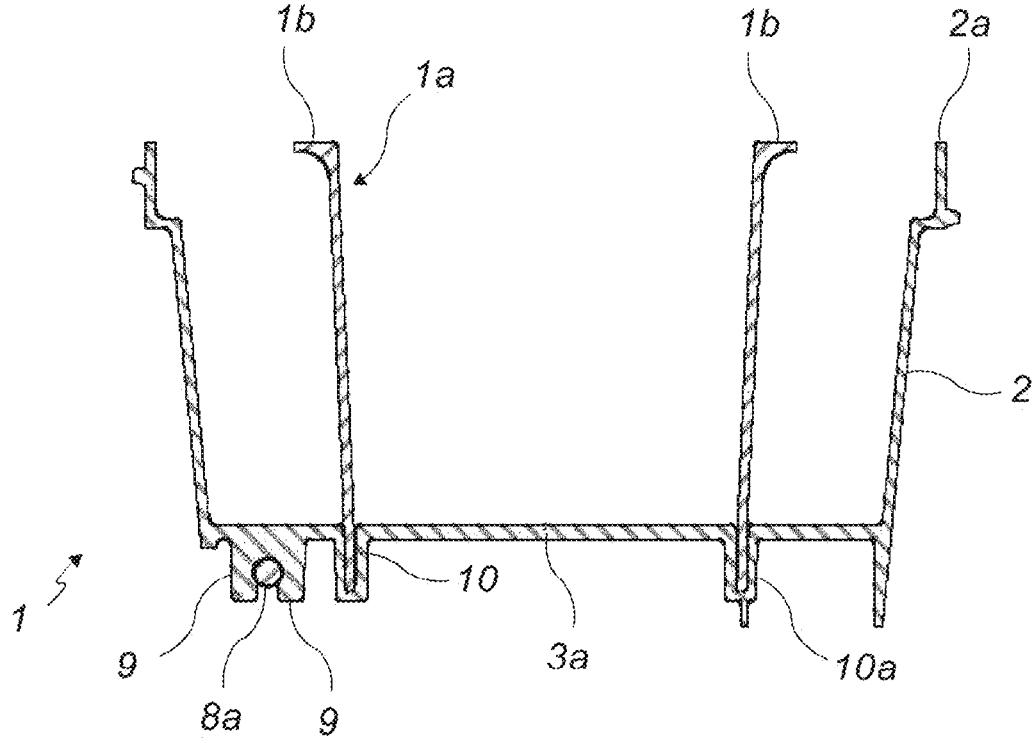
FIG. 10 illustrates the container of FIG. 9 according to another sectional plane.
Figure 11:
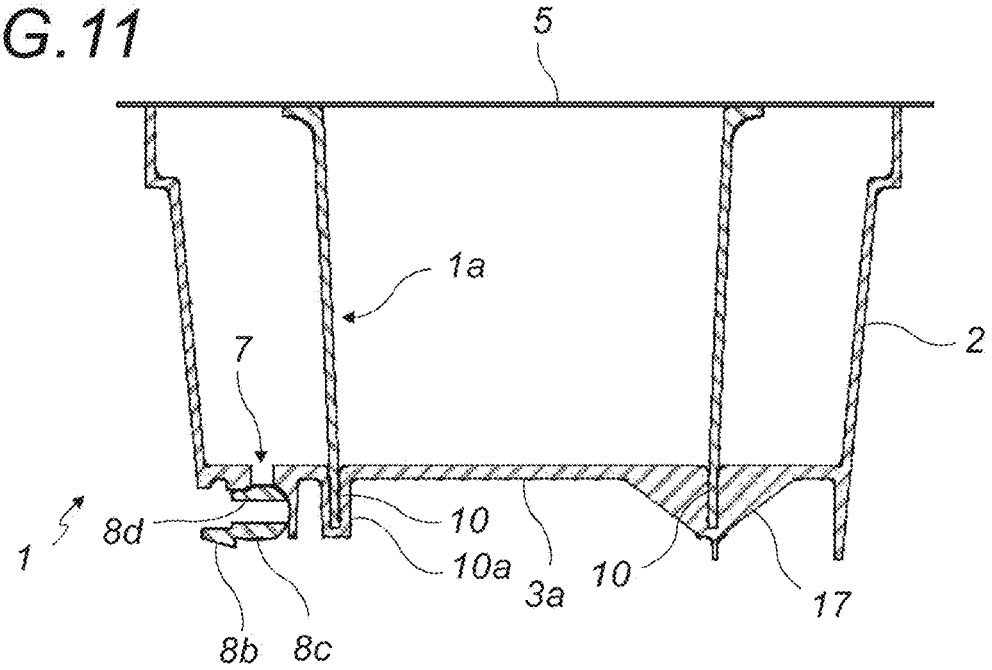
FIG. 11 is an illustration of the container according to the invention of FIGS. 9 and 10 provided with a sealing film and showing the rotary valve in the closed position.
Figure 12:
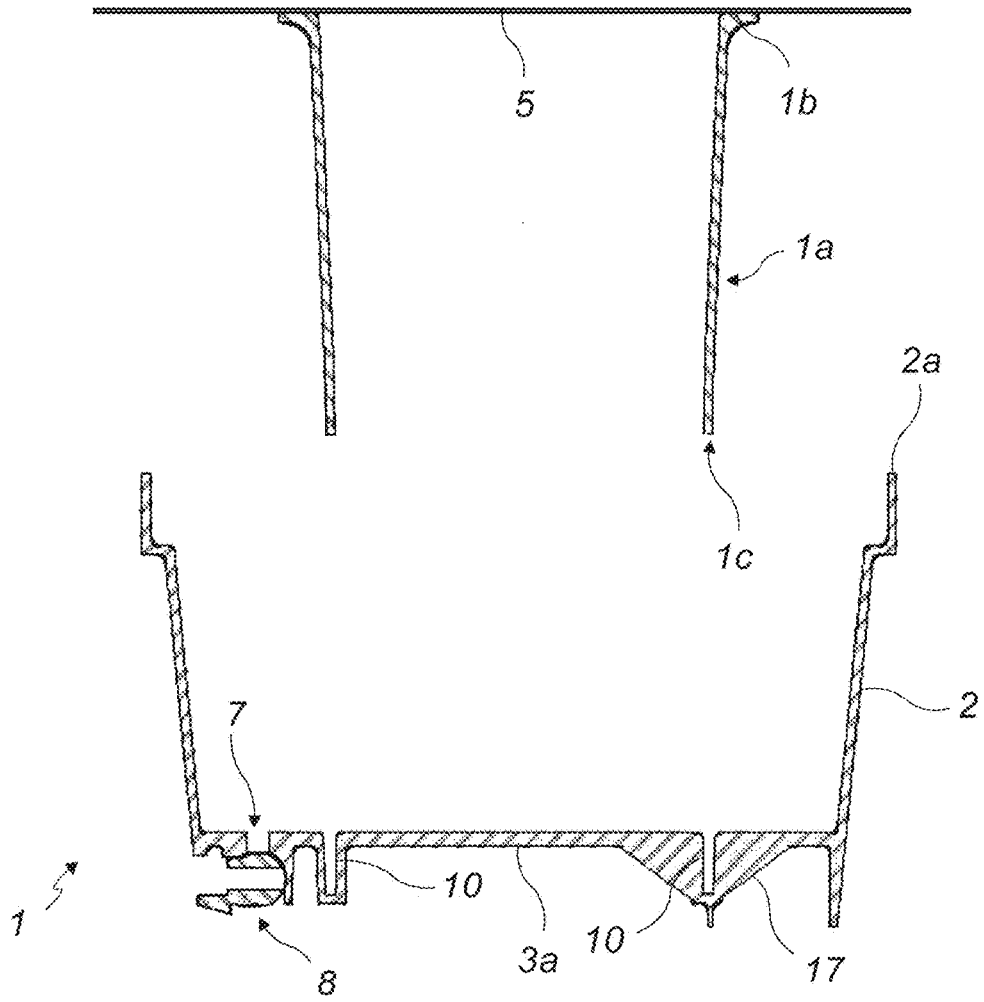
FIG. 12 is an illustration of the container of FIG. 11 during the separation of the sealing film.
Figure 13:
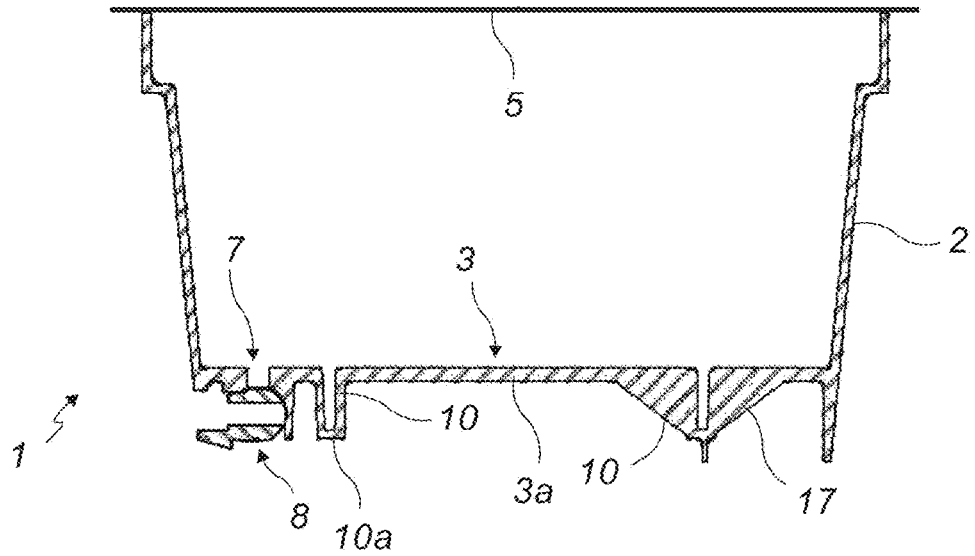
FIG. 13 is another example of use of the container according to the invention, more precisely for mono-component use.

The rotary valve 8 according to the first embodiment is thus illustrated in an open position, for example in FIG. 9 and in a closed position, for example in FIG. 11, 12 or 13.

The container 1 and the jaws 9 are advantageously manufactured as one piece, for example by injection of a plastic material.

The rotation axle 8*a* and the cylindrical portion 8*c* are advantageously manufactured as one piece, for example by injection of a plastic material.

The container 1 according to the invention, illustrated for example in FIG. 1, is pre-filled with at least one product such as paint, varnish or a cleaning agent and comprises a closure member which is advantageously constituted by the sealing film 5.

An exemplary embodiment of the container 1 according to the invention illustrated in FIGS. 2, 9, 10, 11, 12, 14 and 17, relates to a bi-component container 1, intended to contain, in a separated and isolated manner, two distinct components. The latter will be mixed before a spraying operation.

Thus, as can be seen for example in FIG. 2, the container 1 internally comprises the tube 1*a* the lower end 1*c* of which is engaged within a groove 10, that is for example circular and of a rectangular cross section, provided in the bottom 3. The upper end of the tube 1*a* is advantageously provided with a peripheral flat surface 1*b* in order to facilitate the adhesion of the sealing film 5. Particular reference may be made to FIG. 11.

The groove 10 is therefore constituted by means of a U-shape of bottom 3, for example with a radial conical shape on the inner or outer side in order to ensure or improve sealing. According to other embodiments, the sealing may be obtained radially on one side only using sealing lips, tabs in order to realize snap-engagement, nesting or elastic embedding (close fitting engagement using retaining elements) or other sealing elements may be provided, optionally using different materials.

Axial guide ribs may also be provided on the inner tube 1*a* or within the groove with an axial sealing at the bottom of the groove.

The upper section 2*a* of the side wall 2 advantageously has a contact surface that is lower than the contact surface of the flat surface 1*b*. This makes it possible to obtain stronger adhesion between the sealing film 5 and the tube 1*a* than between the sealing film 5 and the upper section 2*a* of the container 1. It is thus easier to extract the tube 1*a* from the container 1, more specifically from the sealed engagement thereof within the groove 10 of the bottom 3, by pulling on the sealing film 5, the tube 1*a* thereby remaining attached to said sealing film 5. This is illustrated for example in FIG. 12.

FIG. 13 illustrates an exemplary embodiment of the container 1 according to the invention which is intended to contain only one component. There is therefore no tube 1*a* and no partition wall arranged within the container 1 or engaged within the groove 10.

Figure 14:
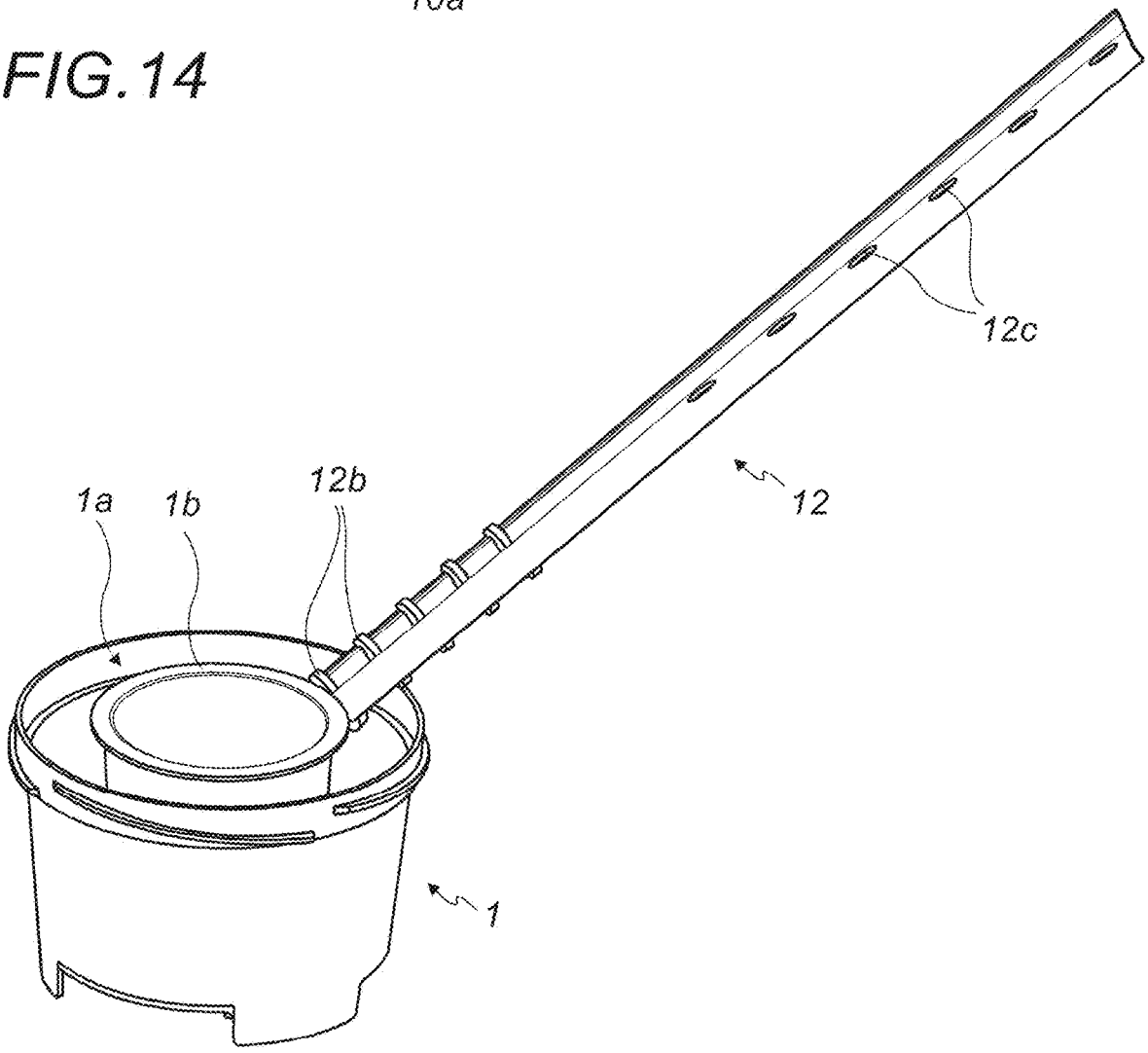
FIG. 14 illustrates the use of the container according to the invention during the extraction of a central tube isolating an additional component.

FIG. 14 illustrates an exemplary embodiment of a bi-component container 1 according to the invention. It is necessary to extract the inner tube 1*a* in order to mix the components respectively stored within said tube 1*a* and peripherally within the container 1 around said tube 1*a*. The latter can also be off-center within the container 1.

The container 1 preferably made of a translucent or opaque plastic material depending upon the nature of the product(s) contained, which may be sensitive to light, in particular to ultraviolet radiation.

Figure 15:
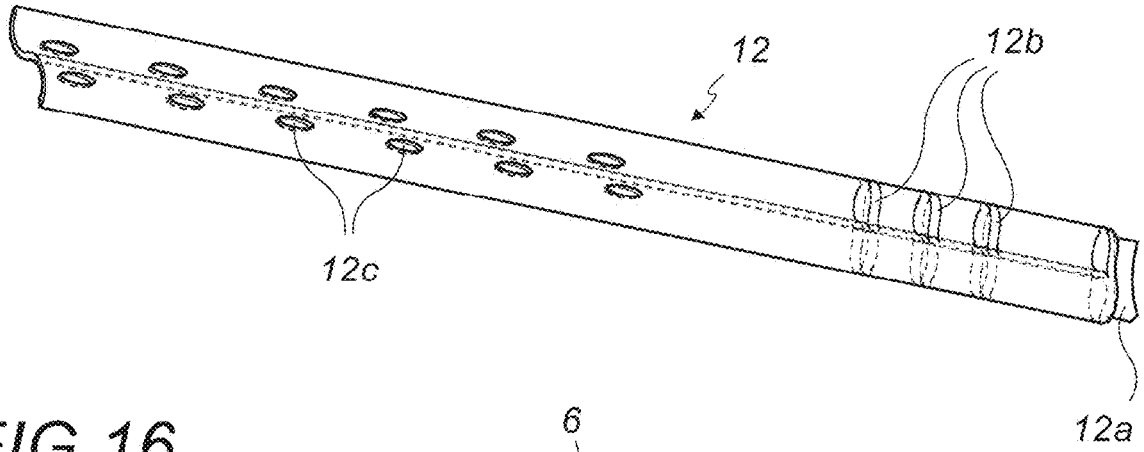
FIG. 15 illustrates a view of FIG. 14.

It may be advantageous to use a hollow stirring rod 12, illustrated in FIGS. 14 and 15 which has a shoulder 12*a* in the form of a leading edge at one of the ends thereof as well as positioning notches 12*b* at the other end thereof. It may thus be useful to engage the shoulder 12*a* beneath the flat surface 1*b* of the inner tube 1*a* by pressing with the rod 12, in particular by means of one of the notches 12*b*, on the upper section 2*a*. Leverage is thus used to lift and remove the tube 1*a* from the container 1 or to initiate the extraction thereof from the groove 10.

Once the inner tube 1*a* is removed from the container 1, it is appropriate to mix the two components within said container 1 by means of the stirring rod 12. For this purpose, the latter is provided with holes 12*c* thereby facilitating the mixing operation.

The container 1 is preferably provided with helical rib portions 13 on the upper and outer side of the peripheral side wall 2 such as to constitute a means of connection to a spray gun 14. Such a connection, known as such, is implemented by means of a lid 15 provided with an outlet opening associated with an adapter. The cover 15 internally comprises mounting means that are complementary to the rib portions 13 in order to be fitted or screwed onto the container 1. The adapter mounted on the outlet opening makes it possible to connect the tank thus formed to the spray gun 14. A filter 16 is preferably integrated into the cover 15.

The tank comprising the container 1 and the cover 15 according to the invention, is intended to be mounted onto a paint or spraying tool, for example a spray gun 14.

The present description mainly focuses on the case of a bi-component or mono-component product. The increase in the number of components results in a relative increase in individual additional volumes containing each of them, within the container 1.

If the final product used after mixing for spraying or propelling is for example a paint, a primer, a coating or a varnish, the first component can be a solvent or a binder and the second component a filler or a hardener.

Figure 16:
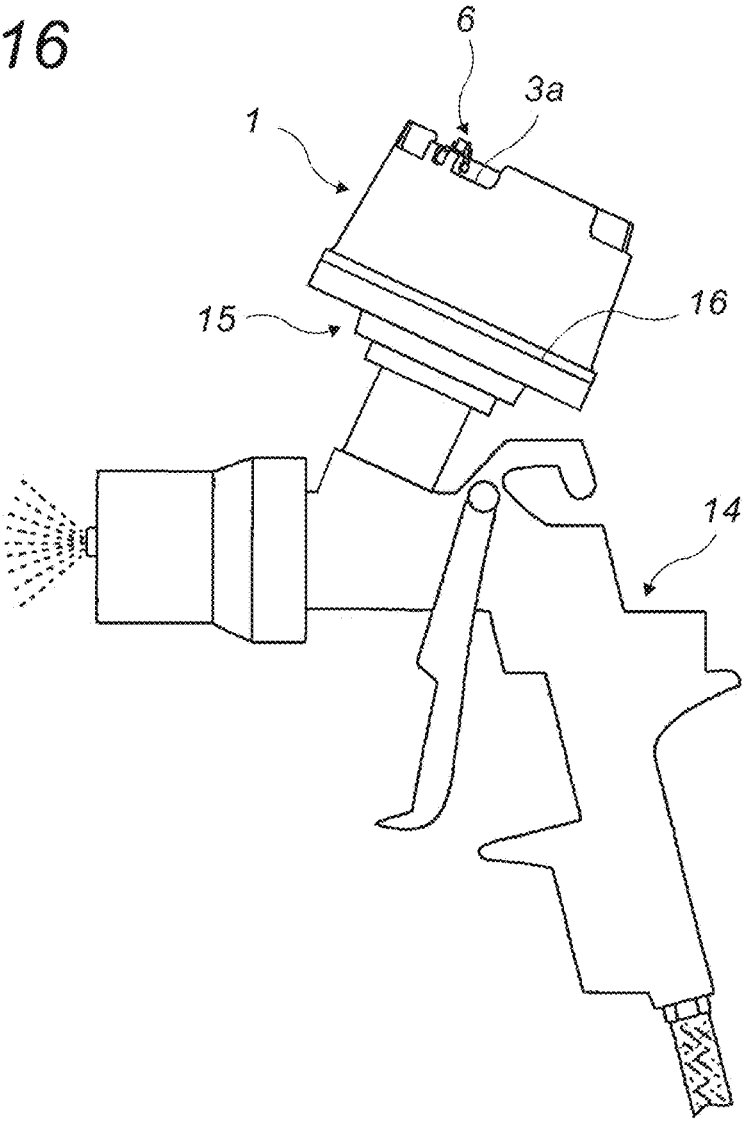
FIG. 16 illustrates an exemplary embodiment of a spraying apparatus upon which the container according to the invention is mounted.

The cover 15 advantageously has an adaptation part or piece or adapter that is provided in order to connect the entire tank of the invention to a spray tool. In the case wherein the disposable container 1 of the invention is intended to be mounted onto a spray gun 14, particularly when gravity fed, the adaptation part or piece comprises a distribution cone or a particular technical form of adaptation to the inlet of the gun 14 such as that shown particularly in FIG. 16. The assembly, also referred to as a tank, comprising the container 1 and the cover 15, thus constitutes a genuine complete cup that is disposable.

Figure 17:
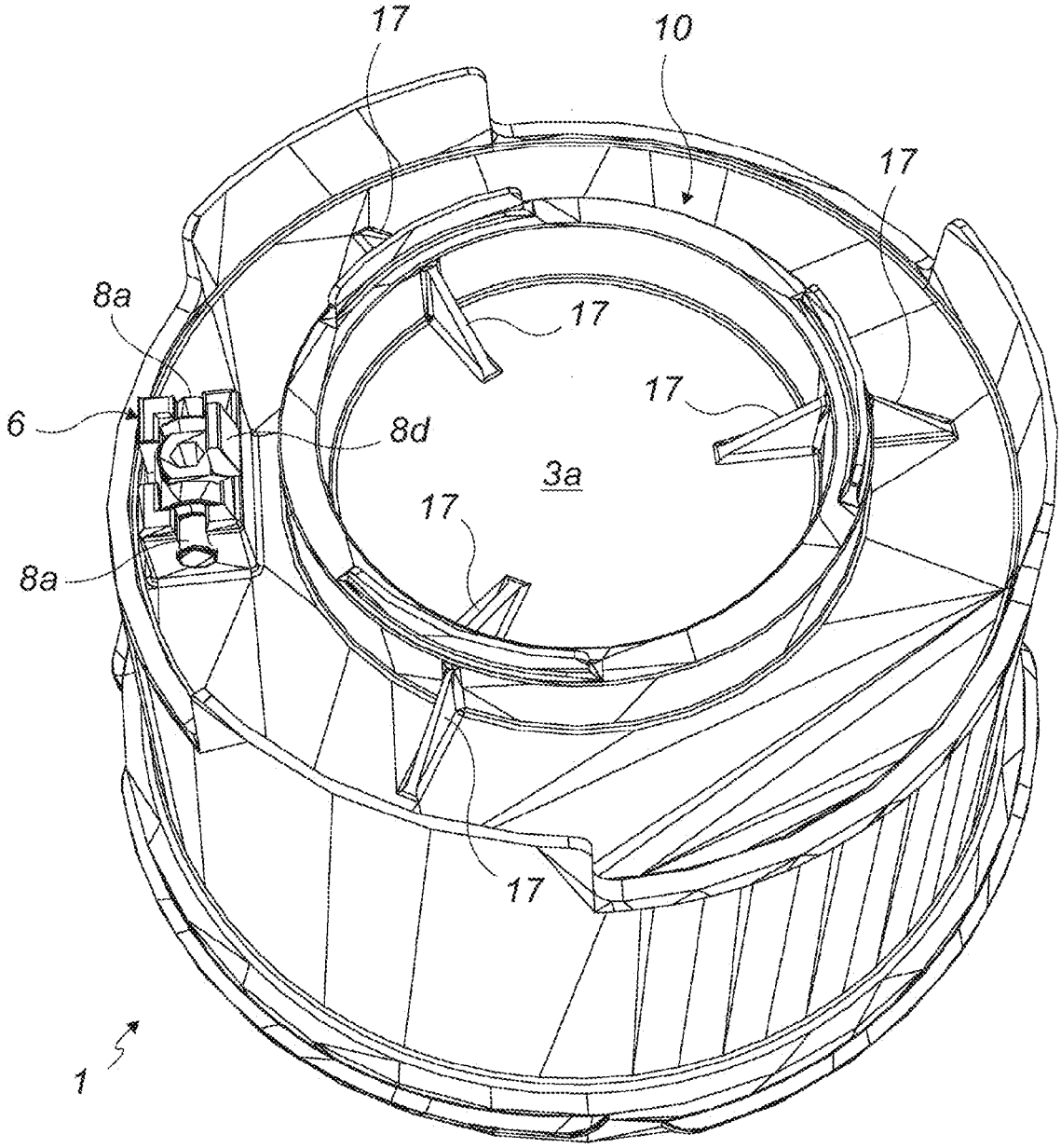
FIG. 17 illustrates an exemplary embodiment of a container according to the invention, in bottom perspective view.

The container 1, illustrated for example in FIG. 17, comprises reinforcements 17 that are integral with the bottom 3 and a portion 10*a* projecting from the outer surface 3*a*, defining the groove 10. The reinforcements 17, for example three in number, have a triangular shape and are distributed substantially in the form of a star along the portion 10*a*. The reinforcements 17 also extend on either side of the circular extension portion 10*a*. The reinforcements 17 thus contribute to limiting or eliminating deformations of the bottom 3, in particular during the operation of closing or sealing the container 1, during which said container is subjected to a number of mechanical stresses.

Obviously, the invention is not limited to the preferred embodiments described above and shown in the various figures, a person skilled in the art being able to make numerous modifications and imagine other variants without going beyond the reach or scope of the invention.

The invention claimed is:

1. A disposable container for containing at least one liquid component to be sprayed, the disposable container comprising: a bottom (3), at least one peripheral side wall (2) extending from the bottom (3) to an open end spaced apart from and facing said bottom (3), which is provided with a closable vent device (6), characterised in that the closable vent device (6) comprises an aperture (7) configured to form an air passage provided in the bottom (3), and a rotary valve (8) mounted on an outer surface (3*a*) of said bottom (3) in an extension of the aperture (7), in order to close and open the air passage, wherein the bottom (3) is positioned opposite a connection end (4), wherein the closable vent device (6) includes a cylindrical portion (8*c*) having a groove (8*e*) configured to open towards the exterior, wherein the groove is located on at least a quarter turn of the cylindrical portion (8*c*) and extends into an actuating lever, in order to, depending upon a rotational position of the rotary valve (8), open the air passage by placing the aperture (7) of the bottom (3) in communication with open air or to close said aperture (7).

2. The container (1) according to claim 1, characterised in that the rotary valve (8) has a rotation axle (8*a*) extending in a plane parallel to the outer surface (3*a*), tightly fitted into jaws (9) that are connected to, and projecting from, said outer surface (3*a*) of the bottom (3).

3. The container (1) according to claim 2, wherein the cylindrical portion (8*c*) is in contact with the outer surface (3*a*) of the bottom (3) and terminating longitudinally at each side by a coaxial end of a smaller diameter in order to constitute the rotation axle (8*a*) engaged within the jaw (9).

4. The container (1) according to claim 3, characterised in that the rotation axle (8*a*) and the cylindrical portion (8*c*) are manufactured as one piece.

5. The container (1) according to claim 1, wherein the actuating lever (8*b*) is rotatable between two positions in abutment constituting end positions, and corresponding respectively to opening and closing of the aperture (7).

6. The container (1) according to claim 5, characterised in that the actuating lever (8*b*), when the rotary valve (8) is in the open position, protrudes on the outer surface (3*a*) of the bottom (3) and extends beyond other parts of the bottom (3) also projecting on said outer surface (3*a*).

7. The container (1) according to claim 1, characterised in that said container (1) and a jaw (9) are manufactured as one piece.

8. The container (1) according to claim 1, characterised in that the container is pre-filled with at least one product, wherein the at least one product comprises at least one of paint, varnish or a cleaning product, and the container comprises a closing element, wherein the closing element comprises at least one of a cover or sealing film (5).

9. The container (1) according to claim 8, characterised in that the container comprises internally at least one removable wall (1*a*) allowing for the realization of at least one sealed compartment for storing and isolating at least one additional component.

10. A tank or cup for a spraying apparatus comprising: a disposable container (1), a removable lid (15) for closing the disposable container (1), said lid (15) being provided with an opening for supplying the spraying apparatus and a filter (16) for filtering the liquid exiting the container (1) through said opening, and an adapter mounted onto the opening in order to realize a detachable connection with said spraying apparatus, wherein the disposable container (1) comprises: a bottom (3), at least one peripheral side wall (2) extending from the bottom (3) to an open end spaced apart from and facing said bottom (3), which is provided with a closable vent device (6), characterised in that the closable vent device (6) comprises an aperture (7) configured to form an air passage provided in the bottom (3), and a rotary valve (8) mounted on an outer surface (3*a*) of said bottom (3) in the extension of the aperture (7), in order to close and open the air passage, wherein the bottom (3) is positioned opposite a connection end (4), wherein the closable vent device (6) includes a cylindrical portion (8*c*) having a groove (8*e*) configured to open towards the exterior, wherein the groove is located on at least a quarter turn of the cylindrical portion (8*c*) and extends into an actuating lever, in order to, depending upon a rotational position of the rotary valve (8), open the air passage by placing the aperture (7) of the bottom (3) in communication with open air or to close said aperture (7).

* * * * *